US006007360A

United States Patent [19]

Wu et al.

[11] Patent Number: 6,007,360

[45] Date of Patent: Dec. 28, 1999

[54] GUIDE SOCKET OF ELECTRICAL CONNECTOR

[75] Inventors: Kun-Tsan Wu, Tu-Chen; Johnson Yang, Tai-Shan, both of Taiwan

[73] Assignee: Hon Hai Precision Ind. Co., Ltd., Taipei Hsien, Taiwan

[21] Appl. No.: 09/333,873

[22] Filed: Jun. 15, 1999

[30] Foreign Application Priority Data

Nov. 17, 1998 [TW] Taiwan ..... 87219013

[51] Int. Cl.[6] ..... H01R 13/627; H01R 13/64

[52] U.S. Cl. ..... 439/350; 439/378

[58] Field of Search ..... 439/378–381, 439/350, 271

[56] References Cited

U.S. PATENT DOCUMENTS 5,466,171 11/1995 Bixler et al. ..... 439/378
5,478,253 12/1995 Beichler et al. ..... 439/567
5,769,555 6/1998 Okada ..... 439/378

*Primary Examiner*—Gary F. Paumen
*Attorney, Agent, or Firm*—Wei Te Chung

[57] ABSTRACT

A guide socket is adapted to be embedded in a first electrical connector for receiving a guide post mounted on a mating second connector to guide the connectors into mating engagement with each other. The guide socket includes a body having an external threading receivingly engaging with an inner-threaded hole defined in the first connector. The guide socket defines a central bore extending through the body for receiving the guide post of the second connector. An inner circumferential groove is formed in the central bore for receiving and retaining a retaining ring therein. The retaining ring has an original inner diameter which is smaller than an outer diameter of the guide post and is resiliently expandable to a larger diameter corresponding to the outer diameter of the guide post for allowing the guide post to extend therethrough and securely retain the guide post in the guide socket by means of a spring-back force caused by the resiliency thereof.

20 Claims, 7 Drawing Sheets

GUIDE SOCKET OF ELECTRICAL CONNECTOR

BACKGROUND OF THE INVENTION

1. Field of the Invention

The present invention generally relates to a device for guiding two connectors into mating engagement with each other, and in particular to a guide socket embedded in an electrical connector for guidingly receiving a guide post of a mating connector.

2. The Prior Art

Electrical connectors that are mateable with mating connectors to establish electrical connection therebetween are well known. To ensure proper engagement between the connectors, guiding means is often adapted therein. Examples are disclosed in U.S. Pat. Nos. 5,446,171 and 5,478,253. The conventional guiding means comprises a post fixed to a first connector which is inserted into a hole defined in a mating second connector. The post and hole pair, although providing the function of guiding the mating connectors, does not generally provide means to securely retain the post in the hole. Thus the physical engagement between the connectors may not be stable.

It is thus desirable to provide a guide device which guides the mating connectors and securely retains the post in the hole for ensuring a stable physical engagement between the connectors.

SUMMARY OF THE INVENTION

Accordingly, an object of the present invention is to provide a guide socket embedded in an electrical connector for guidingly receiving and securely retaining a guide post of a mating connector.

Another object of the present invention is to provide a guide device which guides the mating operation of two connectors while providing electrostatic discharge capabilities thereto.

To achieve the above objects, a guide socket in accordance with the present invention is embedded in a first electrical connector for receiving a guide post mounted on a mating second connector to guide the connectors into mating engagement with each other. The guide socket includes a body having an external threading engaging with an inner-threaded hole defined in the first connector. The guide socket defines a central bore extending through the body for receiving the guide post of the second connector. An inner circumferential groove is formed in the central bore for receiving and retaining a retaining ring therein. The retaining ring has an original inner diameter which is smaller than an outer diameter of the guide post and is resiliently expandable to a larger diameter corresponding to the outer diameter of the guide post for allowing the guide post to extend therethrough and securely retain the guide post in the guide socket by means of a spring-back force caused by the resiliency thereof.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 2:
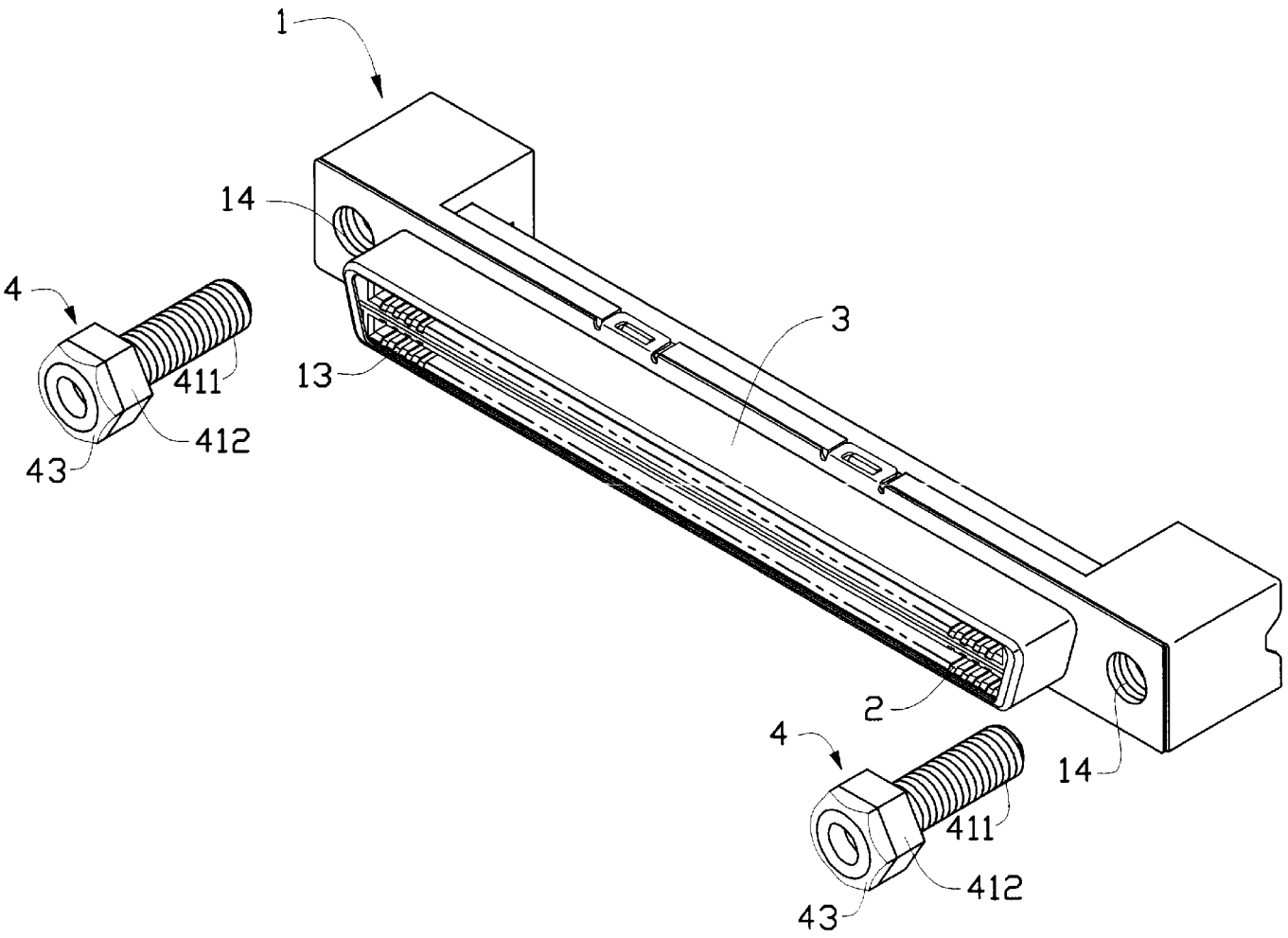
FIG. 2 is a perspective view of an electrical connector and two guide sockets of the present invention to be embedded therein.

Referring to the drawings and in particular to FIG. 2, a guide socket 4 in accordance with the present invention is adapted to be mounted to an electrical connector 1 for receiving a guide post 5 (FIGS. 3A and 3B) of a mating connector in order to guide the mating operation of the connectors. The connector 1 comprises an insulative housing 10 having a front face (not labeled) in which passageways 13 are defined for receiving and retaining contact elements 2 therein. The front face of the housing 10 defines a plurality of inner-threaded holes 14 for receiving and engaging with the guide sockets 4. A shielding member 3 is mounted to the front face of the housing 10.

Figure 1:
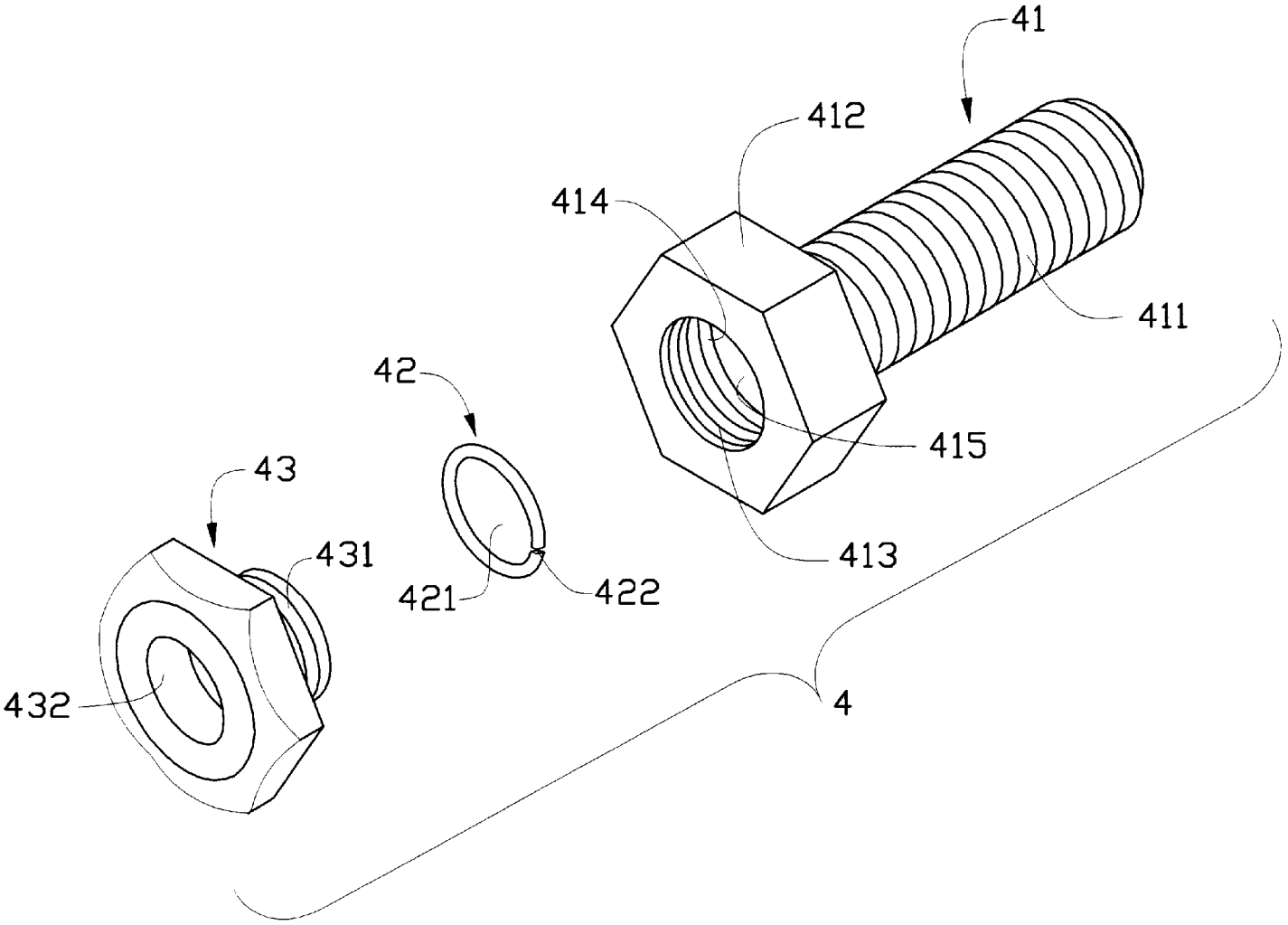
FIG. 1 is an exploded view of a guide socket constructed in accordance with a first embodiment of the present invention.
Figure 3A:
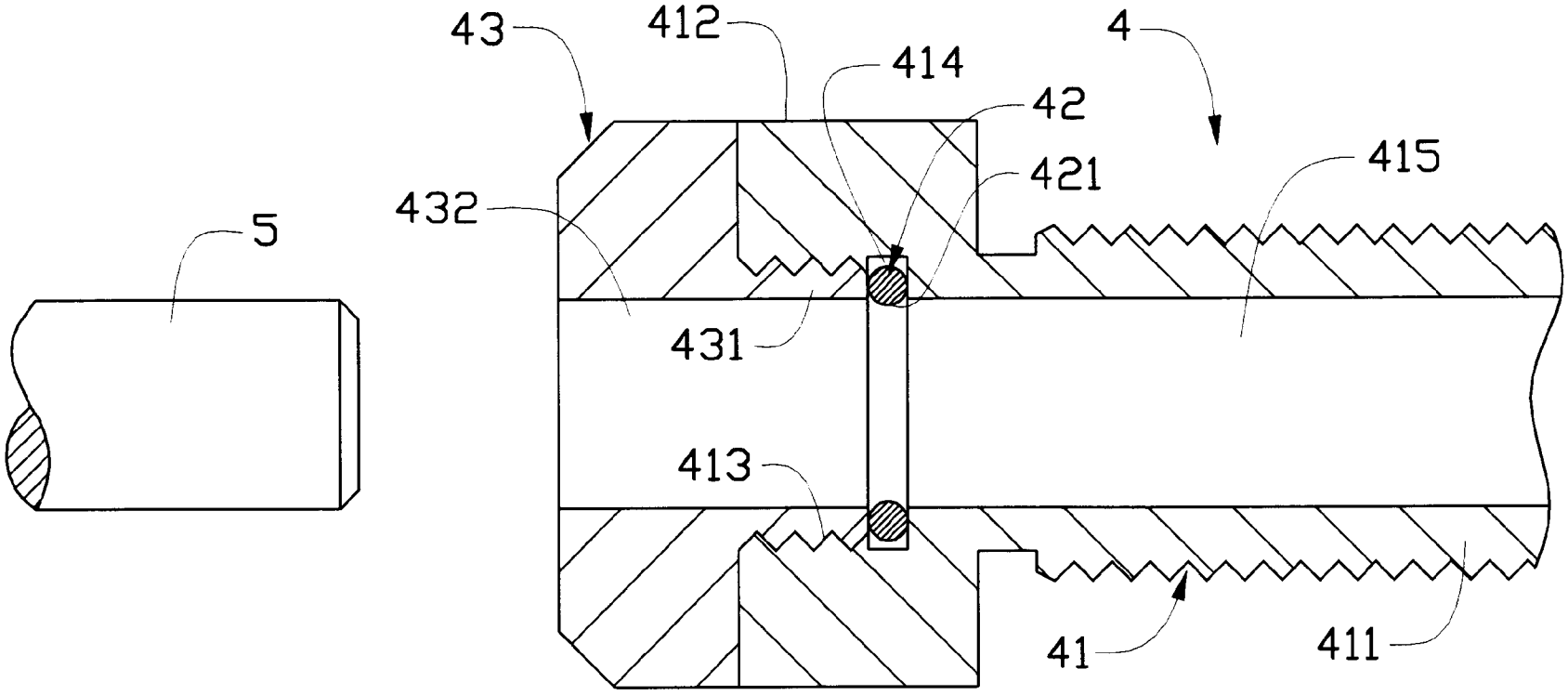
FIG. 3A is a cross-sectional view of the guide socket of FIG. 1, and a guide post of a mating connector to be inserted therein.

Also referring to FIGS. 1 and 3A, the guide socket 4 of the present invention comprises a bolt-like body 41 having a threaded stem 411 engageable with the corresponding hole 14 of the housing 10, and an expanded head 412 projecting beyond the front face of the housing 10 and seated on the shielding member 3 to form electrical engagement therebetween. Preferably, the head 412 has a polygonal cross section, such as hexagon, for facilitating engagement with a wrench.

The body 41 has a central bore 415 axially extending therethrough. A circumferential inner groove 414 is defined in an inside face of the bore 415 for receiving a retaining ring 42 therein. The retaining ring 42 defines a central hole 421 having an inner diameter smaller than the inner diameter of the bore 415. The retaining ring 42 is made of a resilient material which allows the retaining ring 42 to expand and the inner diameter thereof to increase. For this purpose, the retaining ring 42 has a side opening 422 which renders the retaining ring 42 to be C-shaped.

Figure 3B:
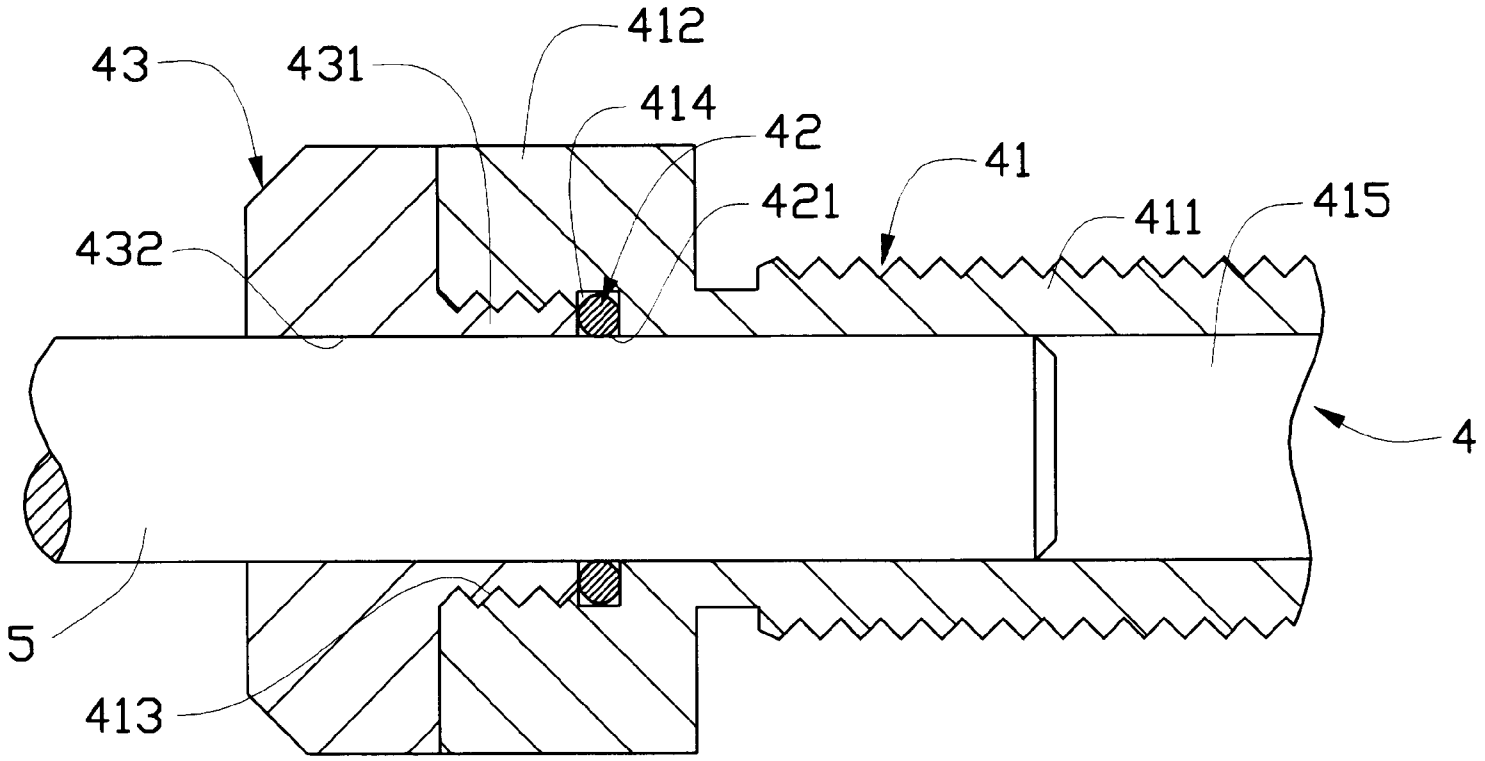
FIG. 3B is a cross-sectional view showing the guide post received in the guide socket of the present invention.

The bore 415 is adapted to receive the guide post 5 of the mating connector as shown in FIGS. 3A and 3B. The inner diameter of the retaining ring 42 is also smaller than the diameter of the guide post 5 whereby a tight engagement is formed between the retaining ring 42 and the post 5 due to the spring-back force caused by the resiliency of the retaining ring 42 when the post 5 is inserted into the bore 415 and extends through the retaining ring 42 which causes the retainer 42 to expand, thereby securely retaining the post 5 in the socket 4. The retaining ring 42 also has a circular cross section as shown in FIGS. 3A and 3B, which facilitates the insertion of the post 5 through the hole 421 of the retaining ring 42.

In the embodiment illustrated, the bore 415 has an expanded inner-threaded section 413 for engaging with a threaded section 431 of a bolt-like end member 43, best seen in FIG. 1. The end member 43 has a central bore 432 of an inner diameter substantially corresponding to that of the bore 415 of the body 41. The end member 43 has a front end spaced from a bottom of the inner-threaded section 413 to define the groove 414 therebetween thereby facilitating mounting the retaining ring 42 therein.

Figure 4:
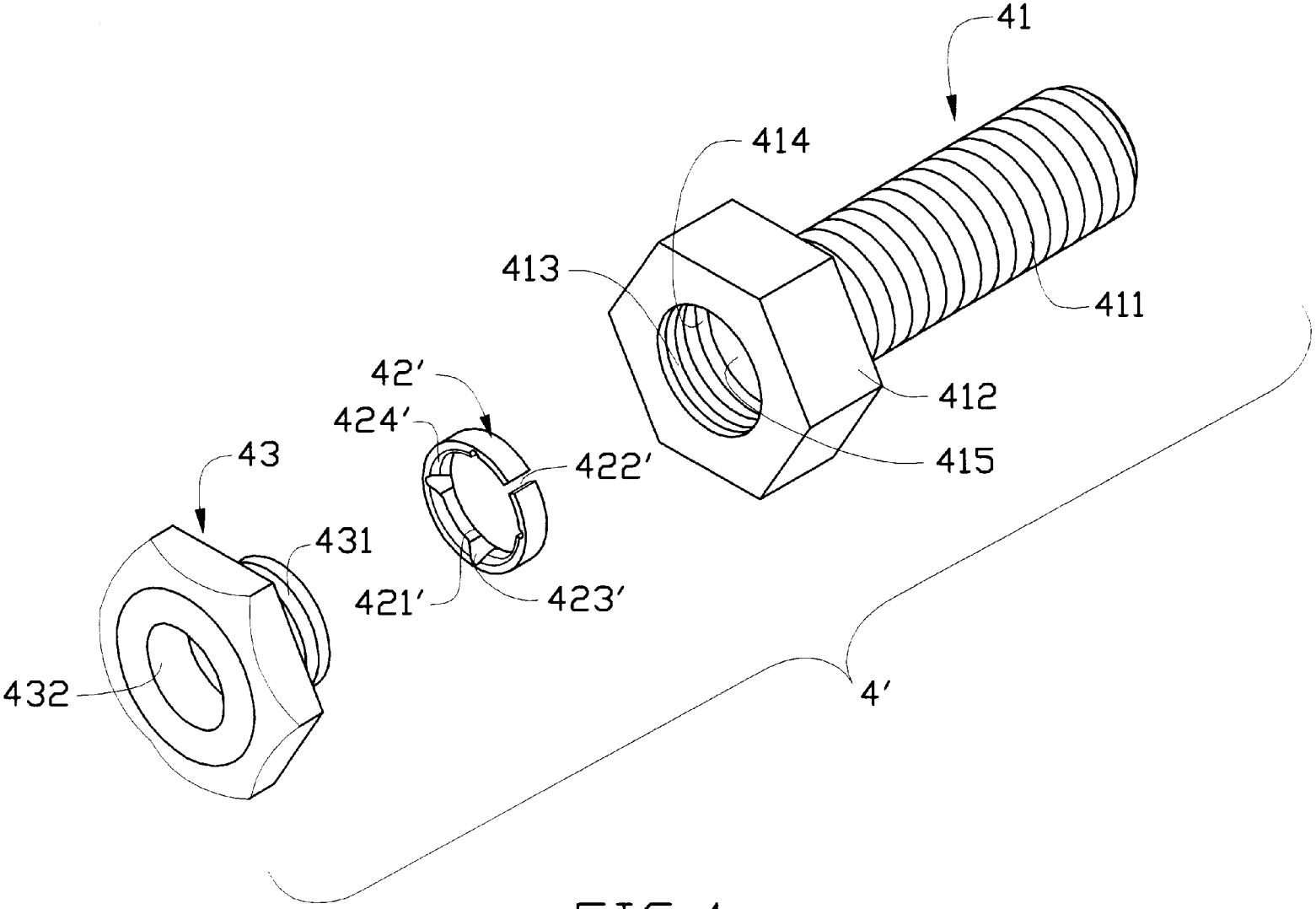
FIG. 4 is an exploded view of a guide socket in accordance with a second embodiment of the present invention.
Figure 5A:
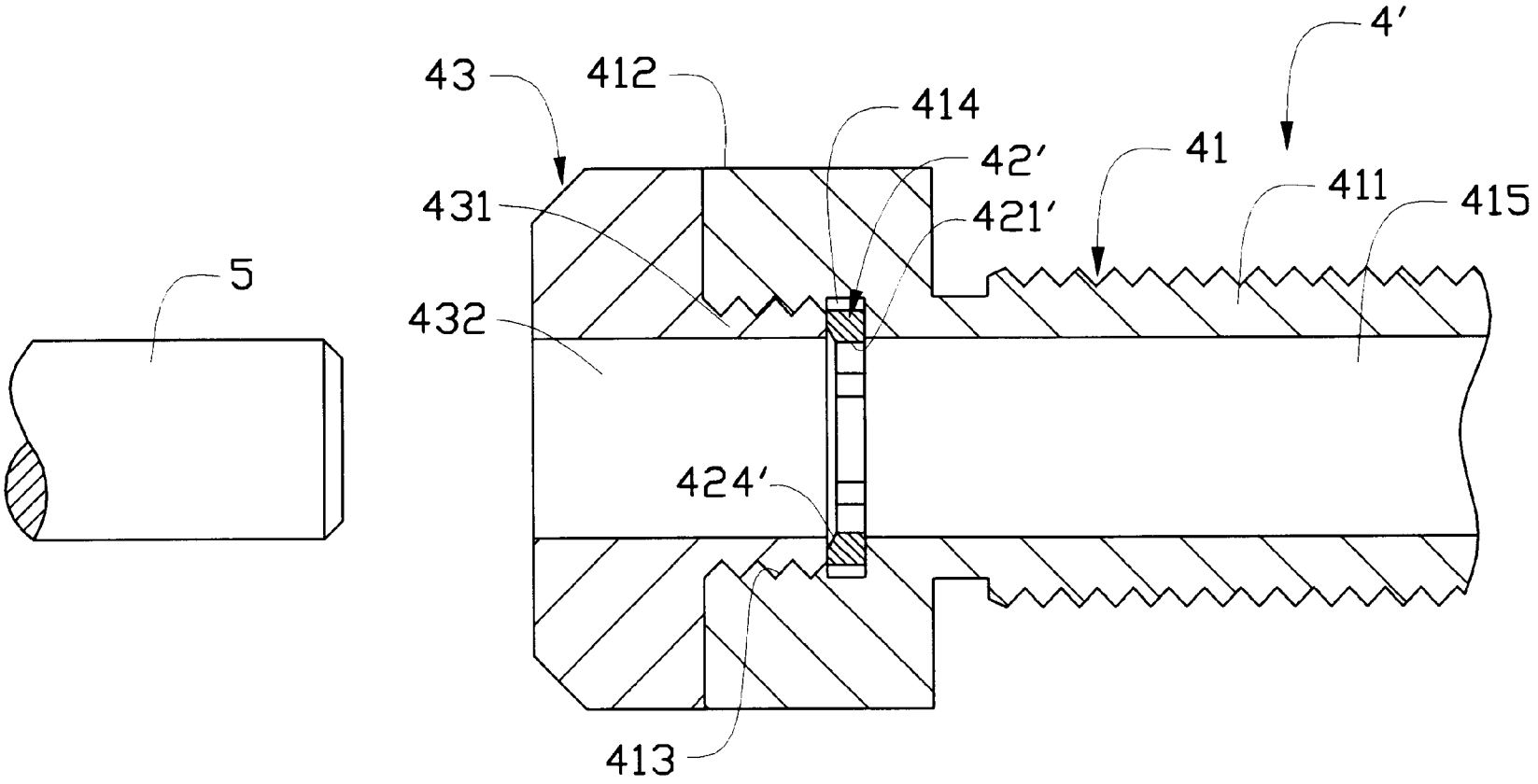
FIG. 5A is a cross-sectional view of the guide socket of FIG. 4, and a guide post of a mating connector to be inserted into the guide socket.
Figure 5B:
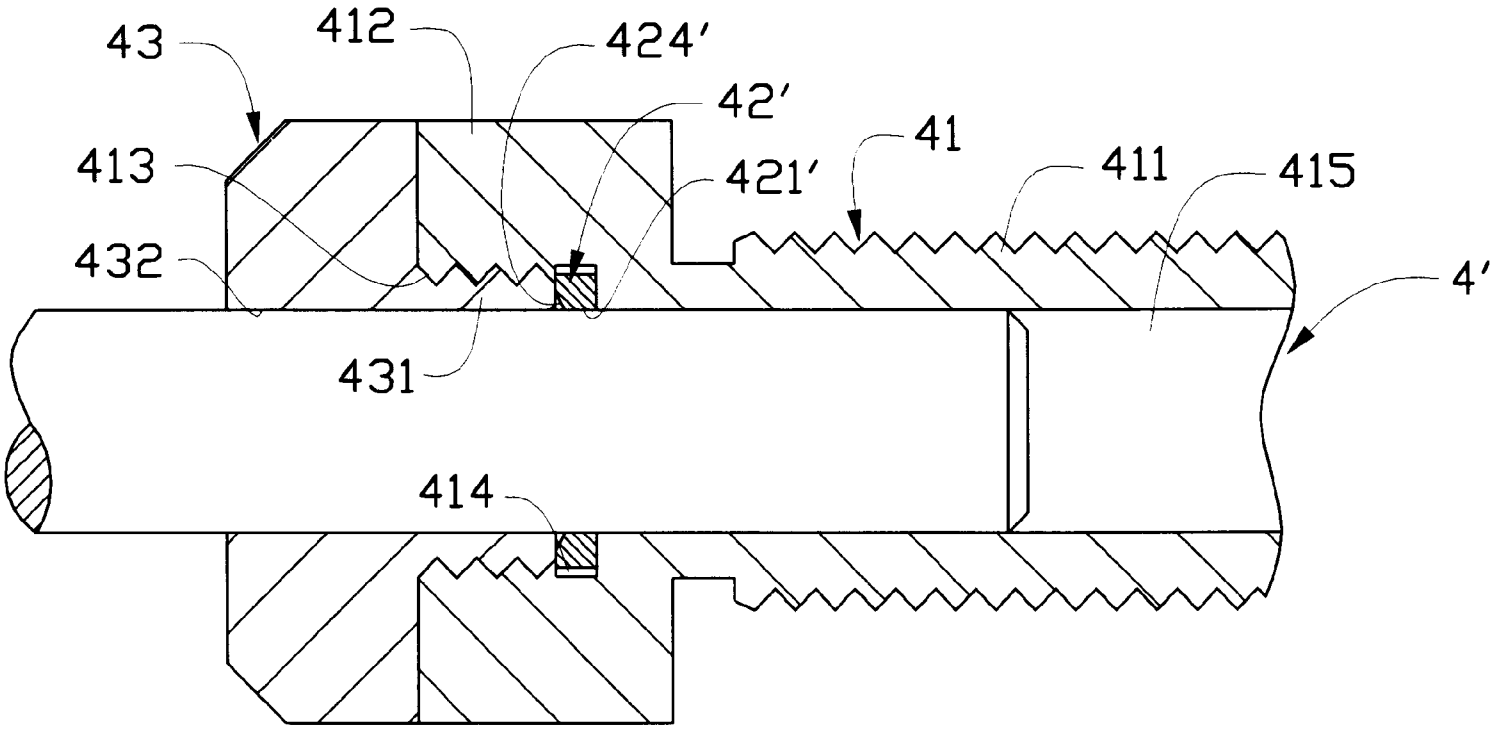
FIG. 5B is a cross-sectional view showing the guide post received in the guide socket of the present invention.

FIGS. 4, 5A and 5B show a second embodiment of the present invention wherein the guide socket is designated by reference numeral 4' and comprises a bolt-like body 41 and an end member 43 identical to and bearing the same reference numerals as those of the first embodiment illustrated in FIGS. 1, 3A and 3B. The C-shaped retaining ring which is designated by reference numeral 42' in the second embodiment, however, is modified to include notches 423' formed in an inner circumference of the central hole 421'. The notches 423', together with an opening 422', facilitate the expansion of the retaining ring 42'.

In the second embodiment, the retaining ring 42' has a cross section approaching a rectangular shape. To facilitate insertion of the post 5 through the central hole 421', the retaining ring 42' has inclined edges 424' formed thereon which are wedgingly engaged by the post 5 to expand the retaining ring 42'.

Although the present invention has been described with reference to preferred embodiments, it is apparent to those skilled in the art that a variety of modifications and changes may be made without departing from the scope of the present invention which is intended to be defined by the appended claims.

What is claimed is:

1. A guide socket adapted to be embedded in a first electrical connector for receiving a guide post mounted on a mating second connector to guide the connectors into mating engagement with each other, the guide socket comprising a body embedded in the first connector and defining a central bore therein for receiving the guide post of the second connector, and a retaining ring disposed in the central bore, the retaining ring defining a central hole having a first inner diameter which is smaller than an outer diameter of the guide post, the retaining ring being resiliently expandable from the first inner diameter to a second inner diameter corresponding to the outer diameter of the guide post for allowing the guide post to extend therethrough and retain the guide post therein.

2. The guide socket as claimed in claim 1, wherein a central bore of the guide socket body defines a circumferential inner groove therein for receiving and retaining the retaining ring.

3. The guide socket as claimed in claim 1, wherein the retaining ring comprises a C-shaped configuration having an opening for facilitating the expansion thereof.

4. The guide socket as claimed in claim 3, wherein the retaining ring has a circular cross section.

5. The guide socket as claimed in claim 3, wherein the retaining ring has an inner circumference forming notches therein.

6. The guide socket as claimed in claim 3, wherein the retaining ring has a rectangular cross section comprising an inclined edge.

7. The guide socket as claimed in claim 1, wherein the body comprises an externally-threaded section receivingly engageable with an inner-threaded hole defined in the first connector.

8. The guide socket as claimed in claim 7, wherein the body further comprises a head having a polygonal cross section.

9. The guide socket as claimed in claim 8, wherein the polygonal cross section is hexagonal.

10. The guide socket as claimed in claim 2, wherein the central bore of the body comprises an expanded, inner-threaded section having a bottom, an end member having a threaded section receivingly engageable with the inner-threaded section of the central bore, the end member having a front end spaced from the bottom of the inner-threaded section of the central bore to form the circumferential groove, the end member having a central bore corresponding to the central bore of the body.

11. An electrical connector comprising an insulative housing receiving and retaining a plurality of contact elements therein, the housing defining at least one inner-threaded hole therein for receiving and fixing a guide socket adapted to receive a guide post of an external connector for guiding the external connector into mating engagement with said electrical connector, the guide socket comprising a body having a threaded section threadingly engaging with the inner-threaded hole of the housing, the body having an axially-extending central bore adapted to receive the guide post, the guide socket further comprising a retaining ring disposed in the central bore, the retaining ring defining a central hole having a first inner diameter which is smaller than an outer diameter of the guide post, the retaining ring being resiliently expandable from the first inner diameter to a second inner diameter corresponding to the outer diameter of the guide post for allowing the guide post to extend therethrough and retain the guide post therein.

12. The electrical connector as claimed in claim 11, wherein the central bore of the body of the guide socket defines a circumferential inner groove therein for receiving and retaining the retaining ring.

13. The electrical connector as claimed in claim 11, wherein the retaining ring has a C-shaped configuration with an opening for facilitating the expansion thereof.

14. The electrical connector as claimed in claim 13, wherein the retaining ring has a circular cross section.

15. The electrical connector as claimed in claim 13, wherein the retaining ring has an inner circumference in which notches are defined.

16. The electrical connector as claimed in claim 13, wherein the retaining ring has a rectangular cross section comprising an inclined edge.

17. The electrical connector as claimed in claim 11, wherein the body of the guide socket comprises a head having a polygonal cross section.

18. The electrical connector as claimed in claim 17, wherein the polygonal cross section is hexagonal.

19. The electrical connector as claimed in claim 12, wherein the central bore of the body of the guide socket comprises an expanded, inner-threaded section having a bottom, an end member having a threaded section receivingly engageable with the inner-threaded section of the central bore, the end member having a front end spaced from the bottom of the inner-threaded section of the central bore to form the circumferential groove, the end member having a central bore corresponding to the central bore of the body of the guide socket.

20. A connector assembly comprising:

a connector including an insulative housing with a plurality of contacts therein, said housing defining a hole;

a guide socket defining a tubular body with a first outer diameter retainably engaged within the hole, and an internal bore defined along said tubular body with a first inner diameter;

a deflectable retaining device within the guide socket around said internal bore and defining a second inner diameter thereabouts; and a complementary connector including a guide post defining a second outer diameter, which generally snugly complies with the first inner diameter but is substantially larger than the second inner diameter, so as to be compliantly received within the internal bore of the guide socket while urging the retaining device to be outwardly deflected, thereby being retainably engaged with said retaining device.

* * * * *